United States Patent [19]

Boersma

[11] 4,064,767

[45] Dec. 27, 1977

[54] CONTROL LEVER ASSEMBLY

[75] Inventor: Richard F. Boersma, Springfield, Ill.

[73] Assignee: Fiat-Allis Construction Machinery, Inc., Deerfield, Ill.

[21] Appl. No.: 740,134

[22] Filed: Nov. 8, 1976

[51] Int. Cl.[2] ..... G05G 1/04; G05G 1/14

[52] U.S. Cl. ..... 74/491; 74/512; 74/523

[58] Field of Search ..... 74/491, 512, 523

[56] References Cited

U.S. PATENT DOCUMENTS

| | | | |
|---|---|---|---|
| 2,884,803 | 5/1959 | Willis | 74/512 |
| 3,451,288 | 6/1969 | Barton et al. | 74/512 |

*Primary Examiner*—Edgar W. Geoghegan

*Attorney, Agent, or Firm*—August E. Roehrig, Jr.; Robert A. Brown; Harvey W. Rockwell

[57] ABSTRACT

A control lever assembly mounted on a panel including a mounting bracket adapted to be mounted to one side of the panel over an opening therein and a pivot pin fixed to the bracket having its axis disposed in a plane parallel to the plane of the opening in the panel. A rotary bearing device surrounds the pin and is journaled thereon to rotate about the pin axis. A handle is fixed to the bearing device and extends through the opening in the panel with the distal end portion of the handle being disposed on the opposite side of the panel. A centrally-apertured, flexible seal member surrounds the handle and is disposed between the bearing device and the mounting bracket to seal the assembly to the one side of the panel.

10 Claims, 8 Drawing Figures

CONTROL LEVER ASSEMBLY

BACKGROUND OF THE INVENTION

This invention relates in general to control lever assemblies and, in particular, to a control lever assembly which may be detachably mounted to a control panel.

More specifically, this invention relates to a control lever assembly for selectively actuating equipment associated with a vehicle.

Many different types and kinds of control lever assemblies are known in the art. While these lever assemblies may be used satisfactorily for some applications, it is desirable to improve control lever assemblies by mounting the control lever in a control panel at an opening therein for sealing the control assembly to the panel. Such a seal must prevent dirt and other undesirable and unwanted materials from contacting the control lever assembly and greatly reduce or eliminate objectionable noises transmitted through the control lever assembly. Such a control lever assembly is highly desirable for use with vehicles such as earth moving equipment including crawler tractors, and other such large vehicles that are operated in conditions wherein the equipment is exposed to mud, dust, dirt, sand and various other highly abrasive material. The lever seal for the control lever assembly must be of a simplified construction to facilitate reliable and dependable operation, while being relatively inexpensive to manufacture.

SUMMARY OF THE INVENTION

It is, therefore, an object of this invention to improve control lever assemblies.

Another object of this invention is to improve the lever seal for control lever assemblies to make the lever seal more effective for sealing the assembly against abrasive material, and damping noise transmitted through the opening in the control panel in which the control lever is mounted.

These and other objects are obtained in accordance with the present invention wherein there is provided a control lever assembly which includes a mounting bracket adapted to be mounted to one side of a control panel over an opening therein. A pivot pin is fixed to the bracket and has its axis disposed in a plane parallel to the plane of the opening in the panel. A rotary bearing device surrounds the pin and is journaled for rotation thereon to rotate about its axis. A lever handle is fixed to the bearing device and extends through the opening in the panel so that a distal end portion of the handle is disposed on the opposite side of the panel. A centrally-apertured, flexible seal member surrounds the handle and is disposed between the bearing device and the bracket to seal the assembly to the one side of the panel. A control linkage extends from the bearing device on the same side of the panel where the seal member is located.

DESCRIPTION OF THE DRAWINGS

Further objects of the invention, together with additional features contribution thereto and advantages accruing therefrom, will be apparent from the following description of two embodiments of the invention when read in conjunction with the accompanying drawings, wherein.

DESCRIPTION OF THE PREFERRED EMBODIMENTS

Referring now to FIGS. 1, 2, 3, 4, 5 and 6 of the drawings, there is shown one embodiment of a control lever assembly 10, which is constructed in accordance with the present invention, and which is mounted on a control panel 11. The control panel 11 may be a part of a vehicle (not shown), and the control lever assembly 10 may serve as a throttle lever or other type of control lever as will become apparent to those skilled in the art. It should be understood that while the control panel 11 is illustrated in a horizontal position, it may be disposed in any other position such as vertical or any desired angular disposition.

Figure 1:
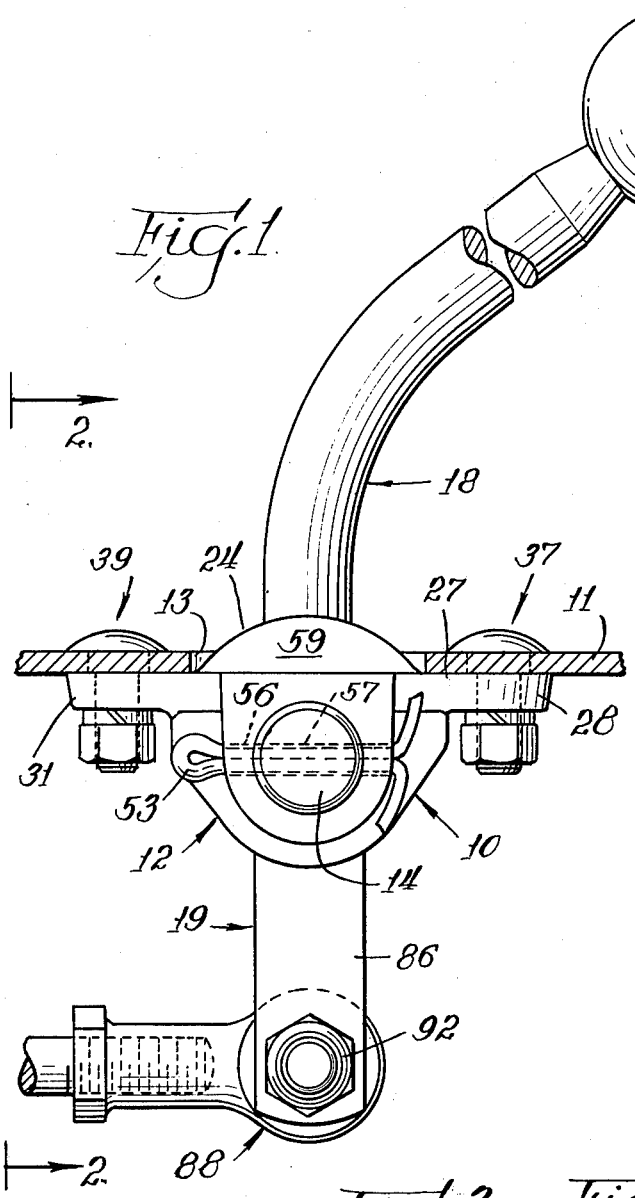
FIG. 1 is a side fragmentary profile view of the control lever assembly constructed in accordance with the present invention.
Figure 2:
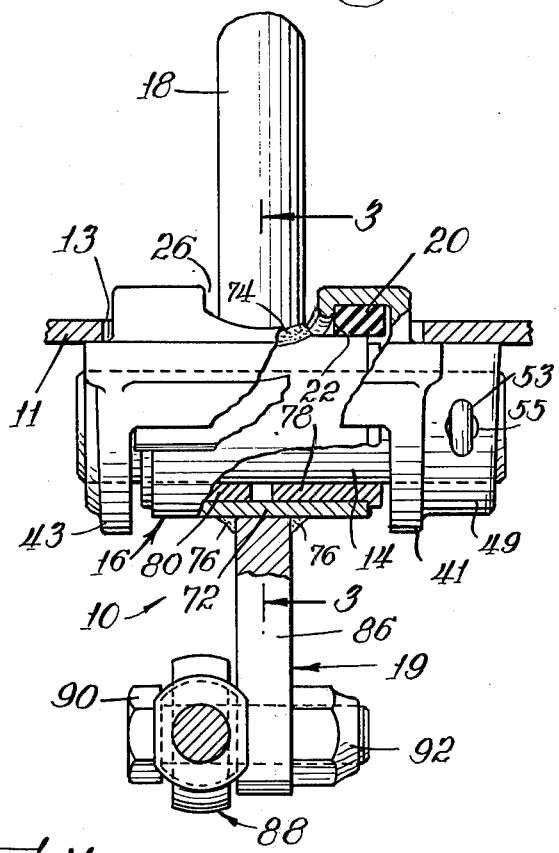
FIG. 2 is a fragmentary, partially broken away cross-sectional view of the control lever assembly of FIG. 1 taken substantially along the line 2—2 thereof.
Figure 3:
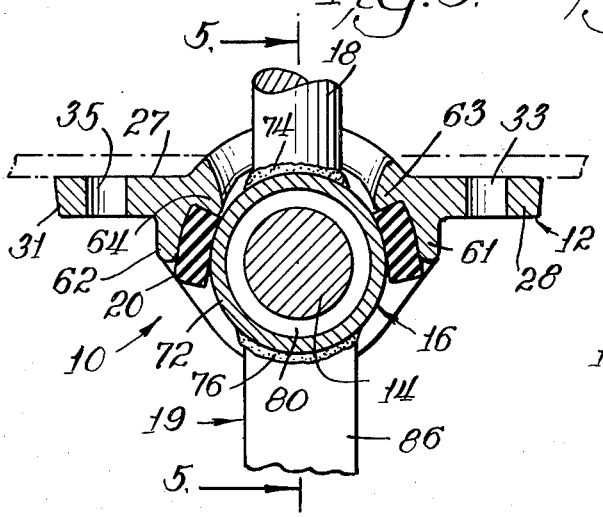
FIG. 3 is a fragmentary cross-sectional view of the control lever assembly of FIG. 2 taken substantially along the line 3—3 thereof.
Figure 5:
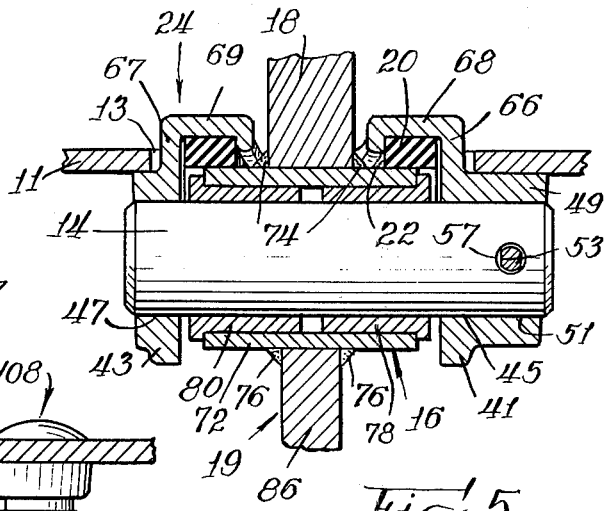
FIG. 5 is a cross-sectional fragmentary view of the control lever assembly of FIG. 3 taken substantially along the line 5—5 thereof.
Figure 6:
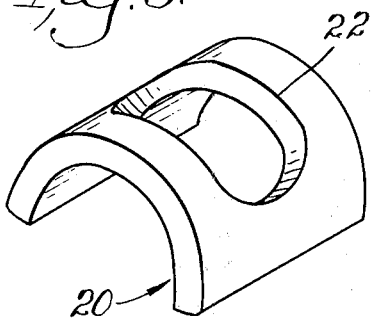
FIG. 6 is a pictorial view of the seal member of the control lever assembly of FIG. 1.

The control lever assembly 10 generally comprises a mounting bracket 12 detachably fixed to the inside of the panel 11 over an opening 13 therein. As best seen in FIGS. 3 and 5 of the drawings, a pivot pin 14 is fixed to the mounting bracket 12, and a rotary bearing device generally indicated at 16, surrounds and rotates about the pivot pin 14. A control lever handle 18 is fixed at one of its ends to the bearing device 16 and extends through the opening 13 in the panel 11. The handle 18 includes a backwardly curved rod, circular in cross-section, with a ball knob fixed to the distal end portion to serve as a hand grip. An actuating linkage or lever arm 19 is fixed at one of its ends to the bearing device 16, at the opposite side thereof from the handle 18, so that the bearing device 16, the handle 18, and the actuating linkage 19 are all fixed together and move pivotally as a unit about the axis of the pivot pin 14. As shown in FIGS. 2, 3, 5 and 6 of the drawings, a flexible lever seal member 20 includes an elongated oval shaped hole 22 for surrounding the handle 18 and is positioned on the underside of a projecting crown portion 24 of the mounting bracket 12. The crown portion 24 has a slightly smaller elongated oval shaped aperture 26 at the uppermost portion thereof aligned with the oval shaped hole 22 for receiving the handle 18 as hereinafter described in greater detail. The seal 20 is disposed between the mounting bracket 12 and the bearing device 16.

In operation, the handle 18 may be moved to pivot about the axis of the pivot pin 14, whereby the bearing device 16 and the linkage 19 move in unison therewith. The seal 20 is a stationary or static seal, and the bearing device 16 moves relative thereto.

Figure 4:
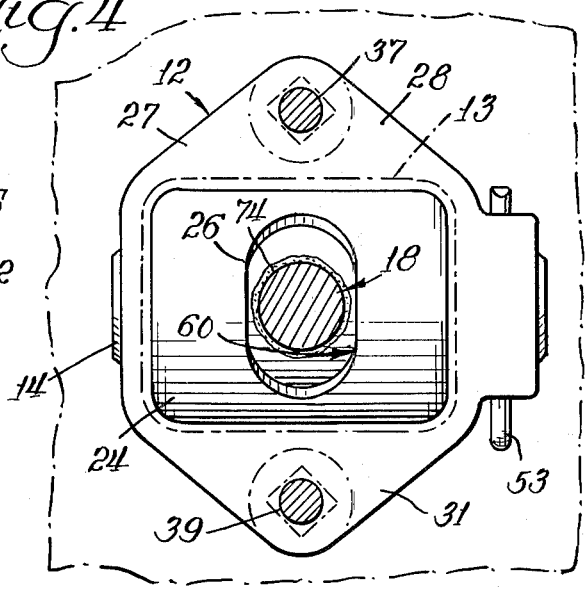
FIG. 4 is a cross-sectional plan view of the control lever assembly of FIG. 1.

Referring now to the mounting device 12 in greater detail as best shown in FIG. 4, the mounting bracket 12 includes an upper flat portion 27 which engages the control panel 11 and is generally rectangular in shape with a pair of oppositely-disposed triangularly shaped integral ears 28 and 31. A pair of holes 33 and 35, in the respective ears 28 and 31, receive a pair of nuts, bolts and lock washers 37 and 39, respectively, to secure the mounting bracket 12 to the control panel 11. A pair of parallel spaced-apart bosses 41 and 43 depend from the underside of the flat portion 27 and have a pair of aligned holes 45 and 47 therein for receiving the opposite end portions of the pivot pin 14. A boss extension or enlargement portion 49 is integrally connected to and extends outwardly from the boss 41. A hole 51 is formed therein and aligned with the hole 45 in the boss 41 for receiving the end portion of the pivot pin 14. A cotter pin 53 extends through a cross hole 55 (FIG. 2) in the enlargement portion 49, and through an aligned cross hole 57 (FIG. 5) in the pivot pin 14 to fix the control lever to the mounting bracket 12.

The crown portion 24 is formed in the shape of a segment of a cylinder and fits within the opening 13 in the panel 11 with the crown portion 24 projecting outwardly from the plane of the panel 11. The crown 24 has a pair of end walls, such as an end wall 59 shown in FIG. 1 of the drawings. The upper surface of the crown portion 24 is smoothly rounded with oval shaped aperture 26 being centrally disposed in the crown portion 24. The elongated oval shaped aperture 26, rounded at its opposite ends and rectangular in its intermediate portion, extends transversely across the crown portion 24 so that the aperture 26 is bowed to follow the contour of the crown portion 24. The elongated aperture 26 extends in the direction of the two holes 33 and 35 in the respective ears 28 and 31.

A rim generally indicated at 60 in FIG. 4 of the drawings, surrounds and defines the elongated aperture of opening 26. As shown in FIGS. 3 and 4 of the drawings, the rim 60 includes a pair of outwardly flared depending end flange portions 61 and 62 for engaging the outer face of the seal member 20. A pair of depending radially extending portions 63 and 64 extend slightly downward from the plane of mounting bracket 12 to the respective flange portions 61 and 62 for engaging the curved portion of the seal member 20 defining the rounded end portions of the aperture 26.

As best shown in FIG. 5 of the drawings, a pair of outwardly projecting intermediate flange portions 66 and 67 of the rim 60 extend opposite the outer edge of the seal member 20. A pair of inwardly extending portions 68 and 69 of the rim 60 overlay and engage the outer face of the seal member 20 with the portions 68 and 69 terminating in downwardly turned distal end portions to engage the portion of the seal member 20 defining the aperture 26. As a result, due to the shape of the rim 60, the seal member 20 is retained in position on the underside of the crown portion 24.

Referring now to the rotary bearing device 16 in greater detail, the bearing device 16 includes a bearing sleeve 72, and is fixed to the handle 18 by means of welds generally indicated 74, and is connected to the actuating linkage 19 by welds generally indicated at 76. A pair of pressed bearing bushings 78 ad 80 are fitted into opposite ends of the bearing sleeve 72 and surround the pivot pin 14 so that the bushings rotate about the pivot pin 14. As a result, the handle 18 and linkage 19 pivot about the axis of the pivot pin which is disposed in a plane parallel to the plane of the opening 13 in the panel 11. A lever arm 86, welded at one of its ends to the sleeve 72, is fixed at its opposite end to a self-aligning ball joint rod end 88. A bolt 90 and a torque nut 92 fix the opposite end of the lever arm 86 to the end of the rod end 88 for effecting actuation of a controlled function.

Figure 7:
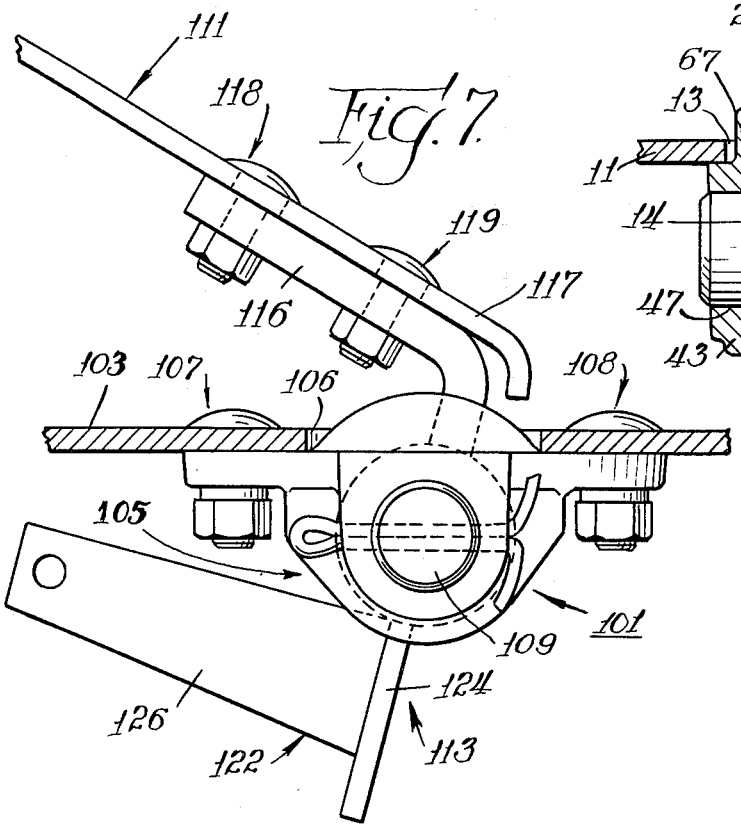
FIG. 7 is a side profile view of another control lever assembly constructed in accordance with the present invention.
Figure 8:
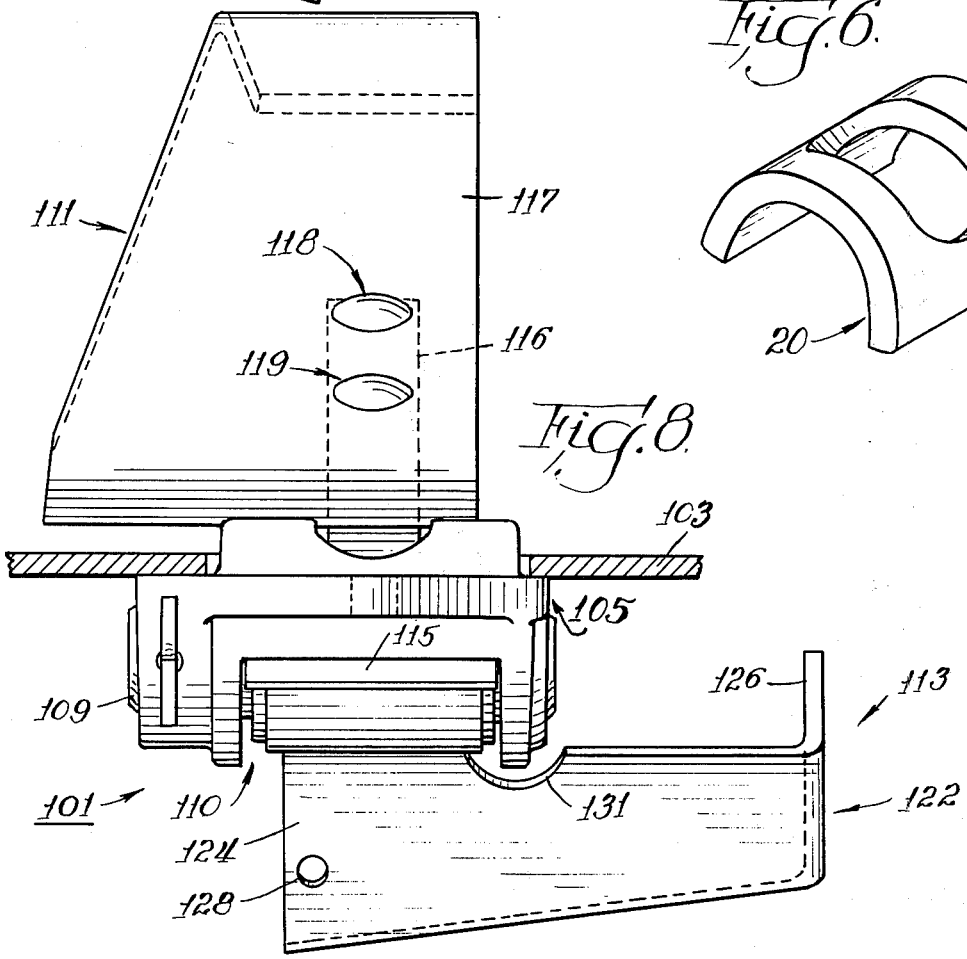
FIG. 8 is a front view of the control lever assembly of FIG. 7.

Referring now to FIGS. 7 and 8 of the drawings, there is disclosed an alternative embodiment of a control lever assembly 101, which is also constructed in accordance with the present invention and is similar to the control lever assembly 10 except for the handle and linkage portions thereof. The control lever assembly 101 is attached to the panel 103 by means of a mounting bracket 105 similar to the mounting bracket 12 of the assembly 10. The mounting bracket 105 is attached to the panel 103 over an opening 106 in the panel 103 by means of nuts, bolts, and washers generally indicated at 107 and 108. A pivot pin 109 is fixed through the mounting bracket 105 in the same manner as the pivot pin 14 is attached to the mounting bracket 12. A rotary bearing device 110, similar to the bearing device 16, is rotatably mounted on the pivot pin 109 in a similar manner as the bearing device 16 is mounted on the pivot pin 14. A foot pedal 111 and actuating linkage or lever arm 113 are fixed to and extend from opposite end portions of the bearing device 110. The foot pedal 111 extends through the opening 106 in the panel 103, and a flexible lever seal 115, similar to the seal member 20, is used for a similar purpose.

The foot pedal 111 includes a forwardly bent portion 116 which is fixed at one of its ends to the bearing device 110, and has an actuator plate 117 mounted thereon by means of nuts and bolts generally indicated by 118 and 119. In operation actuator plate 117 is depressed to cause the foot pedal 111 to pivot about the axis of the pivot pin 109. It is to be understood that the control lever assembly 101 may be arranged in different orientations as will be apparent to those skilled in the art.

The lever arm 113 generally includes an angle member 122 having a base portion 124 fixed at one end portion thereof to the bearing device 110, and a distal end portion 126. Movement of the foot pedal 111 moves the lever arm 113 in unison with the bearing device 110 similar to the corresponding parts of the control lever assembly 10 to effect actuation of a controlled function connected to the distal end portion 126 for facilitating the connections of the controlled function to the lever arm 113. The base portion 124 extends laterally and includes, as best shown in FIG. 8 of the drawings, a hole 128 to be engaged by a spring (not shown) to bias the foot pedal 111 in an upward direction and a notch or cut-out 131 to enable the base portion 124 to clear portions of the mounting bracket 105.

While the present invention has been described in connection with particular embodiments thereof, it will be understood that many changes and modifications of this invention may be made by those skilled in the art without departing from the true spirit and scope thereof. Accordingly, the appended claims are intended to cover all such changes and modifications as fall within the true spirit and scope of the present invention.

What is claimed is:

1. A control lever assembly adapted to be mounted on a panel for actuating a controlled function, comprising a mounting bracket adapted to be mounted to one side of said panel over an opening therein, a pivot pin fixed to said bracket and having its axis disposed in a plane parallel to the plane of said opening, bearing means surrounding said pin and journalled for rotation thereon to rotate about said pivot pin axis, a handle fixed to said bearing means for movement thereof and extending through said opening with a distal end portion being disposed on the opposite side of said panel, a centrally-apertured, flexible seal member surrounding said handle and disposed between said bearing means and said bracket for sealing said assembly to said one side of said panel, and a control linkage extending from said bearing means on said one side of said panel to the controlled function for movement with said handle for actuating said controlled function.

2. The apparatus of claim 1, wherein said mounting bracket includes a projecting crown portion positioned within the opening in the panel, said seal member includes a hole formed therein for receiving said handle, and said crown portion has an aperture formed therein disposed in alignment with the hole in said seal member for receiving said handle.

3. The apparatus of claim 2, wherein said crown portion is in the shape of a segment of a cylinder and said seal member is complementary shaped to fit in underlying engagement with said crown portion.

4. The apparatus of claim 1, wherein said mounting bracket includes a flat portion adapted to engage said panel and a pair of parallel spaced-apart bosses depending from said flat portion for supporting said pivot pin.

5. The apparatus of claim 4, wherein said mounting bracket further includes an enlarged portion integrally connected to one of said bosses, said bosses and said enlarged portion having holes therein aligned for receiving said pivot pin, said pivot pin and said enlarged portion having a pair of aligned cross holes, and a cotter pin extending through said aligned cross holes for fixing said pin to said mounting bracket.

6. The apparatus of claim 1, wherein said bearing means includes bushing means surrounding said pivot pin and a bearing sleeve surrounding said bushing means for sealingly engaging said seal member, said handle and said linkage being fixed to said sleeve and extending from diametrically opposite sides thereof.

7. The apparatus of claim 1, wherein said mounting bracket includes a crown portion projecting therefrom, having an elongated oval shaped aperture therein, with a rim disposed on said mounting means to surround said aperture.

8. The apparatus of claim 7, wherein said rim includes at the opposite end portions thereof a pair of outwardly flared depending end flange portions and a pair of slightly downwardly depending radially extending portions disposed substantially at right angles to said flange portions, and at oppositely disposed intermediate end portions thereof a pair of outwardly projecting intermediate flange portions and a pair of inwardly extending portions terminating in downturned distal end portions thereof to retain said seal member in position at the underside of said mounting bracket.

9. The apparatus of claim 1, wherein said handle includes a backwardly curved portion terminating in a knob, and said linkage includes a link fixed at one of its ends to said bearing means and fixed at its other end to a self-aligning ball rod end.

10. The apparatus of claim 1, wherein said handle includes a forwardly bent portion, said forwardly bent portion being attached to an actuator plate, and said linkage including an angle member having a distal end portion extending substantially parallel to the distal end portion of said forwardly bent portion.

* * * * *